US005676583A

United States Patent [19]

Wang et al.

[11] Patent Number: 5,676,583

[45] Date of Patent: Oct. 14, 1997

[54] PERFUMED DOLL

[75] Inventors: Sung-Mao Wang; Hsien-Sheng Chung, both of P.O. Box 82-144; Meng-Shan Chou; Loong-Kuen Lee, all of Taipei, Taiwan

[73] Assignees: Sung-Mao Wang; Hsien-Sheng Chung, both of Taipei, Taiwan

[21] Appl. No.: 695,593

[22] Filed: Aug. 12, 1996

[51] Int. Cl.[6] ..... A63H 3/00

[52] U.S. Cl. ..... 446/268; 446/74; 239/55

[58] Field of Search ..... 446/72–74, 268, 446/267; 239/34, 44, 55, 50; 222/78

[56] References Cited

U.S. PATENT DOCUMENTS

| | | | |
|---|---|---|---|
| 2,618,892 | 11/1952 | Locks et al. | 446/268 |
| 3,770,199 | 11/1973 | Hoek et al. | 239/55 X |
| 5,037,343 | 8/1991 | Benites | 446/268 |
| 5,437,410 | 8/1995 | Babasade | 239/55 |

*Primary Examiner*—Mickey Yu
*Attorney, Agent, or Firm*—Alfred Lei

[57] ABSTRACT

A perfumed doll including a doll, an outer tubular member inserted into the doll, the outer tubular member being open at both ends thereof and provided with internal threads at an upper end thereof, a collar fixedly mounted on the upper end of the outer tubular member and formed with a neck at a central portion thereof, a sleeve having a neck snugly fitted into a lower end of the outer tubular member, an inner tubular member open at a top thereof, the inner tubular member being provided with an enlarged end at a bottom thereof and external threads at an upper end thereof, the inner tubular member being inserted into the outer tubular member with the external threads engaged with the internal threads, and a wick fitted within the inner tubular member and extending upwardly out of the collar.

3 Claims, 3 Drawing Sheets

PERFUMED DOLL

BACKGROUND OF THE INVENTION

1. Field of the Invention

This invention is related to a doll and in particular to one which can give a sweet and pleasant smell.

2. Description of the Prior Art

It has been found that the conventional doll is simply a figure of a human being, usually as a child's toy. Dolls with movable arms, legs and heads are well known in the art. However, none of them can give a sweet and pleasant smell, as of flowers, thereby making them unable to fulfill somebody's desire.

Therefore, it is an object of the present invention to provide a doll which can give a sweet and pleasant smell.

SUMMARY OF THE INVENTION

This invention relates to a perfumed doll.

It is the primary object of the present invention to provide a doll which can give a sweet and pleasant smell.

It is another object of the present invention to provide a perfumed doll which can be filled with liquid perfume or solid fragrant substance.

It is still another object of the present invention to provide a perfumed doll in which the perfume can be conveniently refilled.

It is still another object of the present invention to provide a perfumed doll which is simple in construction.

It is a further object of the present invention to provide a perfumed doll which is low in cost.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
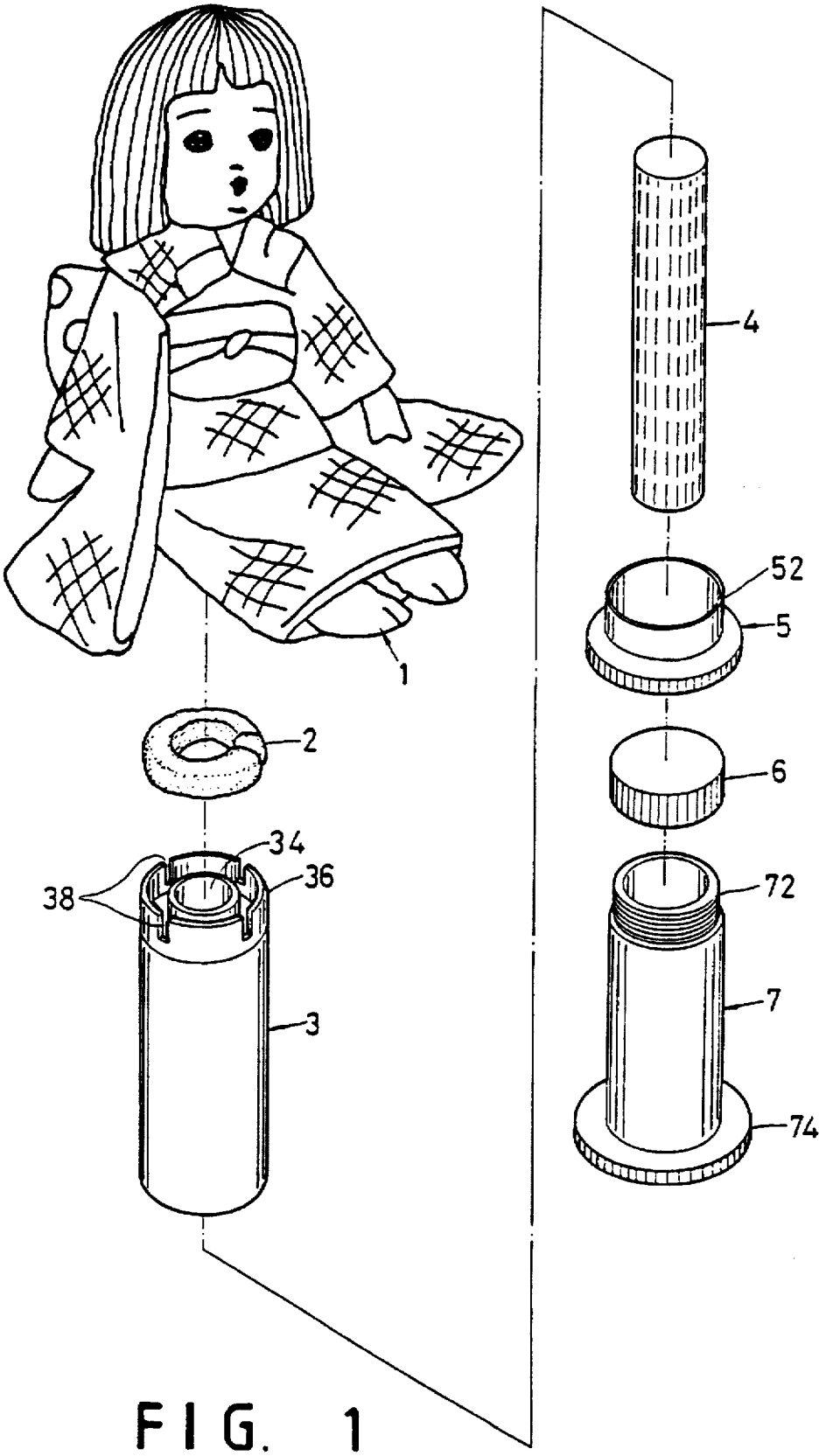
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
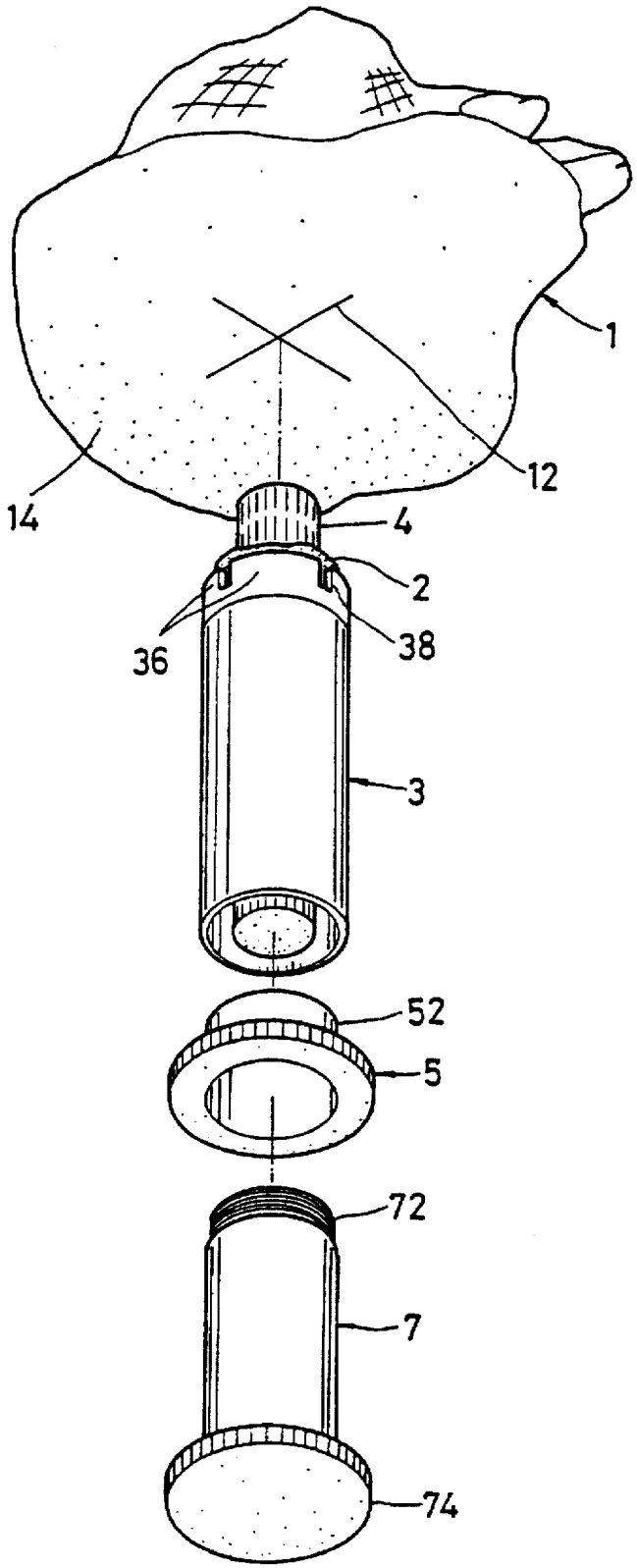
FIG. 2 illustrates the installation of the present invention.

With reference to the drawings and in particular to FIGS. 1 and 2 thereof, the perfumed doll according to the present invention mainly comprises a doll 1, a cotton rope 2, an outer tubular member 3, a collar 36, a wick 4, a sleeve 5, a cap 6, and an inner tubular member 7.

The doll 1 is the model of a child and has a cross-shaped slit 12 at the bottom thereof.

Figure 3:
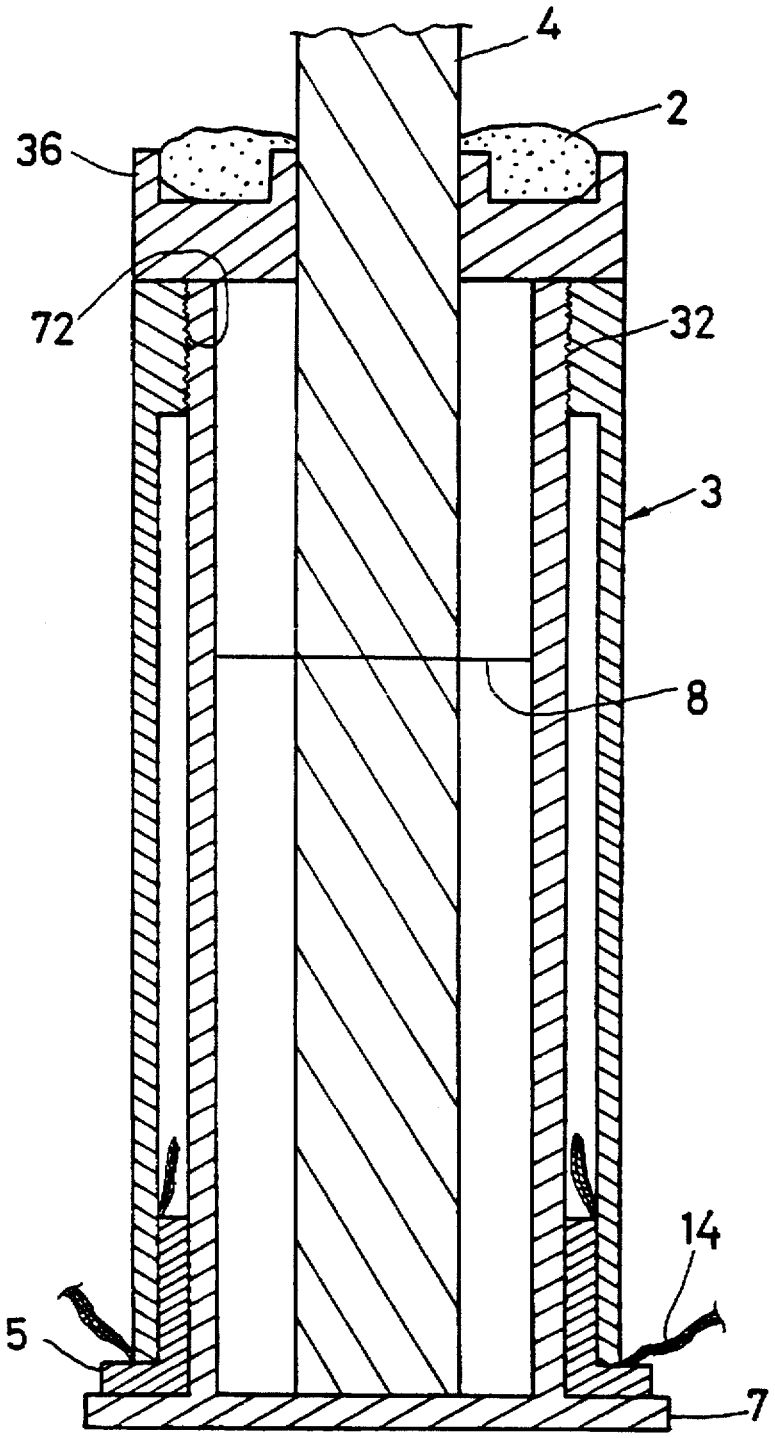
FIG. 3 is a sectional view of the present invention.

The outer tubular member 3 is inserted into the doll 1 from the bottom through the cross-shaped slit 12. The outer tubular member 3 is open at both ends and provided with internal threads at the upper end (see FIG. 3).

The collar 36 is fixedly mounted on the upper end of the outer tubular member 3 by adhesive or the like. The collar 36 is formed with a neck 34 at the central portion and a plurality of notches 38 along the circumferential wall (see FIGS. 1 and 3). The cotton rope 2 is fitted within the collar 36 between the neck 34 and the circumferential wall.

The sleeve 5 is a tubular member formed with an annular ring-like portion 52 at the upper portion thereof. The annular ring-like portion 52 of the sleeve 5 is snugly fitted into the lower end of the outer tubular member 3 so that the bottom 14 of the doll 1 is firmly kept between the outer tubular member 3 and the sleeve 5 thereby fixing the outer tubular member 3 in the doll 1 (see FIGS. 1 and 3).

The inner tubular member 7 is open at the top and provided with an enlarged bottom 74. The upper end of the inner tubular member 7 is provided with external threads 72. The inner tubular member 7 is inserted into the outer tubular member 3, with the external threads 72 of the former engaged with the internal threads of the latter. The inner tubular member 7 is used for receiving perfume 8 (see FIG. 3) and is provided with a cap 6 for preventing the perfume from flowing out thereof. The cap 6 must be removed before inserting the inner tubular member 7 into the outer tubular member 3.

The wick 4 is inserted into the inner tubular member 7 through the neck 34 of the collar 36 and is arranged in contact with the cotton rope 2 for increasing the evaporation rate of the perfume thereby enabling it to produce a strong and pleasant smell in a short period of time.

When desired to use solid fragrant substance instead of perfume, it is only necessary to remove the wick 4 from the inner tubular member 7 and the cotton rope 2 from the collar 36 and then put the solid fragrant substance into the outer tubular member 3.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A perfumed doll comprising:

a doll;

an outer tubular member inserted into said doll, said outer tubular member being open at both ends thereof and provided with internal threads at an upper end thereof;

a collar fixedly mounted on the upper end of said outer tubular member and formed with a neck at a central portion thereof;

a sleeve having a neck snugly fitted into a lower end of said outer tubular member;

an inner tubular member open at a top thereof, said inner tubular member being provided with an enlarged end at a bottom thereof and external threads at an upper end thereof, said inner tubular member being inserted into said outer tubular member with said external threads engaged with said internal threads; and a wick fitted within said inner tubular member and extending upwardly out of said collar.

2. The perfumed doll as claimed in claim 1, further comprising a cotton rope fitted in said collar and arranged in contact with said wick.

3. The perfumed doll as claimed in claim 1, wherein said collar is formed with a plurality of notches on a circumferential wall thereof.

* * * * *